US005215309A

United States Patent [19]

Joel

[11] Patent Number: 5,215,309

[45] Date of Patent: Jun. 1, 1993

[54] HEALTH GAME

[76] Inventor: Deborah L. Joel, 2127 Ashburton St., Baltimore, Md. 21216

[21] Appl. No.: 923,725

[22] Filed: Aug. 3, 1992

Related U.S. Application Data

[63] Continuation-in-part of Ser. No. 641,203, Jan. 15, 1991, Pat. No. 5,143,378.

[51] Int. Cl.[5] ..... A63F 3/00

[52] U.S. Cl. ..... 273/243

[58] Field of Search ..... 273/242, 243, 244, 246, 273/429, 430

[56] References Cited

U.S. PATENT DOCUMENTS

| | | | |
|---|---|---|---|
| 895,128 | 8/1908 | Trant | 273/243 |
| 2,415,073 | 1/1945 | Buffmire | 273/243 |
| 3,989,251 | 11/1976 | Barlaw | 273/243 X |
| 4,040,628 | 8/1977 | Pope | 273/243 |
| 4,159,117 | 6/1979 | Kuna | 273/243 |
| 4,273,376 | 6/1981 | Carrera et al. | 273/243 |
| 4,279,422 | 7/1981 | Shaw | 273/243 X |
| 4,372,592 | 2/1983 | Summers | 273/243 |
| 4,718,675 | 1/1988 | Rosenberg et al. | 273/243 |

FOREIGN PATENT DOCUMENTS

| | | | |
|---|---|---|---|
| 2380044 | 10/1978 | France | 273/243 |
| 2554359 | 5/1983 | France . | |
| 2544624 | 10/1984 | France . | |
| 1482321 | 8/1977 | United Kingdom . | |
| 2084027 | 4/1982 | United Kingdom . | |
| 2186497 | 8/1987 | United Kingdom . | |

*Primary Examiner*—Vincent Millin
*Assistant Examiner*—William E. Stoll
*Attorney, Agent, or Firm*—David Newman & Associates

[57] ABSTRACT

An educational device employing a game situation to teach preventive health care concepts to the family. The educational device generally includes a playing board apparatus; two playing surfaces, with each playing surface having a plurality of locations defining a travel path; a plurality of playing pieces; health question-answer cards; and a chance device for determining the advancement of the playing pieces along the travel path. Each playing surface includes playing locations for answering health problem questions, and the first playing surface also includes preventive health care locations, water boy locations, and game direction locations for use in a first version of the health game with a match card, score point cards, penalty point cards, preventive health care certificates, and water boy locations. The Health Game simulates a real-to-life situation where players are confronted with health questions and health problems. In a first version of the Health Game, the health problems acquired by the players may be overcome by possessing the appropriate preventive health care certificate.

15 Claims, 4 Drawing Sheets

Fig. 2
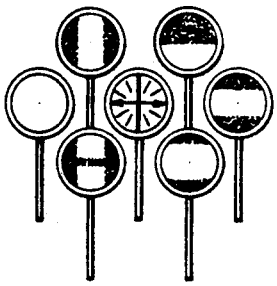
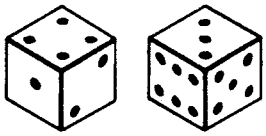
Fig. 3
151. RABIES IS A DESEASE SPREAD BY
A HUMANS
B ANIMALS
C PLANTS
ANS: ANIMALS
Fig. 4
110
A.I.D.S.
1000 PENALTY POINTS
Fig. 5A
110
Fig. 5B
NONSMOKER HEALTH CERTIFICATE
Fig. 6
35
EXERCISER
Fig. 7
20
WATER BOY
Fig. 8

Fig. 9

ADVANCE FIVE SPACES

Fig. 10

NONSMOKER

120

Fig. 11A

PENALTY POINT CARD

200 PENALTY POINTS

Fig. 11B

PENALTY POINT CARD

500 PENALTY POINTS

Fig. 11C

PENALTY POINT CARD

1000 PENALTY POINTS

Fig. 12A

SCORE POINT CARD

200 PENALTY POINTS

Fig. 12B

SCORE POINT CARD

500 PENALTY POINTS

Fig. 12C

SCORE POINT CARD

1000 PENALTY POINTS

HEALTH GAME

RELATED PATENTS

This patent is a continuation-in-part of a patent application entitled, HEALTH GAME, having Ser. No. 07/641,203, and filing date Jan. 15, 1991, now U.S. Pat. No. 5,143,378, issued Sep. 1, 1992. All matter from the parent patent application is incorporated herein by reference, and the benefit of the earlier filing date of the parent patent application is claimed pursuant to 35 U.S.C. @ 120.

BACKGROUND OF THE INVENTION

The present invention relates to board games and more particularly to board games which may be played by persons of varying ages and which have the combined purposes of providing entertainment and education in the health care discipline.

DESCRIPTION OF THE PRIOR ART

There are known in the art a large Variety of board games based on and directed to various situations, such as financial games, athletic games, dieting games, and the like. However, so far as is known, no board games have been developed around the theme of health games having different health problems and preventive health care situations, with an object of teaching health education and teaching health care and the prevention of health problems.

OBJECT AND SUMMARY OF THE INVENTION

An object of the invention is to provide a health game for teaching health education.

Another object of the invention is to provide a health game for teaching prevention of health problems and teaching health care.

A further object of the invention is to provide a health game having two playing surfaces, with one playing surface providing a simpler version for younger children to play.

A further object of the invention is to provide a health game which simulates a real-to-life situation where players are confronted with health problems that threaten an otherwise healthy life.

According to the present invention, as embodied and broadly described herein, a board game is provided comprising manually manipulable means, a plurality of playing pieces, a plurality of health question cards, and a game board. The manually manipulable means bear indicia for making a chance selection, and may be embodied as one or more dice. The plurality of playing pieces each represent a player. The plurality of health question cards contain player questions. The game board has a first playing surface and a second playing surface, with each of the first and second playing surfaces having a first series of playing locations, a second series of playing locations, and a third series of playing locations. The playing locations of the first, second, and third series of playing locations of both the first and the second playing surfaces may be embodied as squares on the first and second playing surfaces, respectively. On the first playing surface, a first series of playing locations, defined about the first playing surface of the playing board around the perimeter of the first playing surface, is in substantially contiguous relationship and comprises a playing path in which the playing pieces are moved in discrete steps between successive locations.

The second series of playing locations of the first playing surface is defined about the first playing surface in substantially contiguous relationship and is located within the first series of playing locations of the first playing surface. The second series of playing locations of the first playing surface comprises a playing path in which the playing pieces are moved in discrete steps between successive locations. The first series of playing locations of the first playing surface includes at least one location that a player whose piece lands thereon is to move to the second series of playing locations of the first playing surface.

The third series of playing locations is defined about the first playing surface in substantially contiguous relationship and is located within the first and second series of playing locations of the first playing surface. The third series of playing locations of the first playing surface comprises a playing path in which the playing pieces are moved in discrete steps between successive locations. The second series of playing locations of the first playing surface includes at least one location that a player whose piece lands thereon is to move to the third series of playing locations of the first playing surface. The first, second and third series of playing locations of the first playing surface include at least one location indicating that a player whose piece lands thereon contracts a health problem, at least one location indicating that a player whose piece lands thereon obtains a preventive health care certificate, and at least one location indicating that the player whose piece lands thereon follows a game direction.

Similarly, on the second playing surface, a first series of playing locations, defined about the second playing surface of the playing board around the perimeter of the second playing surface, is in substantially contiguous relationship and comprises a playing path in which the playing pieces are moved in discrete steps between successive locations. The second series of playing locations of the second playing surface is defined about the second playing surface in substantially contiguous relationship and is located within the first series of playing locations of the second playing surface. The second series of playing locations of the second playing surface comprises a playing path in which the playing pieces are moved in discrete steps between successive locations. The first series of playing locations of the second playing surface includes at least one location that a player whose piece lands thereon is to move to the second series of playing locations of the second playing surface.

The third series of playing locations is defined about the second playing surface in substantially contiguous relationship and is located within the first and second series of playing locations of the second playing surface. The third series of playing locations of the second playing surface comprises a playing pat in which the playing pieces are moved in discrete steps between successive locations. The second series of playing locations of the second playing surface includes at least one location that a player whose piece lands thereon is to move to the third series of playing locations of the second playing surface.

Additional objects and advantages of the invention are set in part in the description which follows, and in part are obvious from the description, or may be learned by practice of the invention. The objects and advantages of the invention also may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate a preferred embodiment of the invention, and together with the description serve to explain the principles of the invention.

FIG. 2 illustrates playing pieces;

FIG. 3 shows a pair of dice;

FIG. 4 illustrates health question cards having player questions;

FIG. 5A illustrates a health problem location of the first surface of the playing board;

FIG. 5B illustrates a playing location of the second surface of the playing board;

FIG. 6 illustrates a preventive health care certificate;

FIG. 7 illustrates an exerciser location;

FIG. 8 illustrates a water boy location;

FIG. 9 illustrates a location with a game direction;

FIG. 10 illustrates a preventive health care location;

FIGS. 11A-11C illustrate penalty point cards; and

FIGS. 12A-12C illustrate score point cards.

DETAILED DESCRIPTION OF THE PREFERRED EMBODIMENTS

Figure 1A:
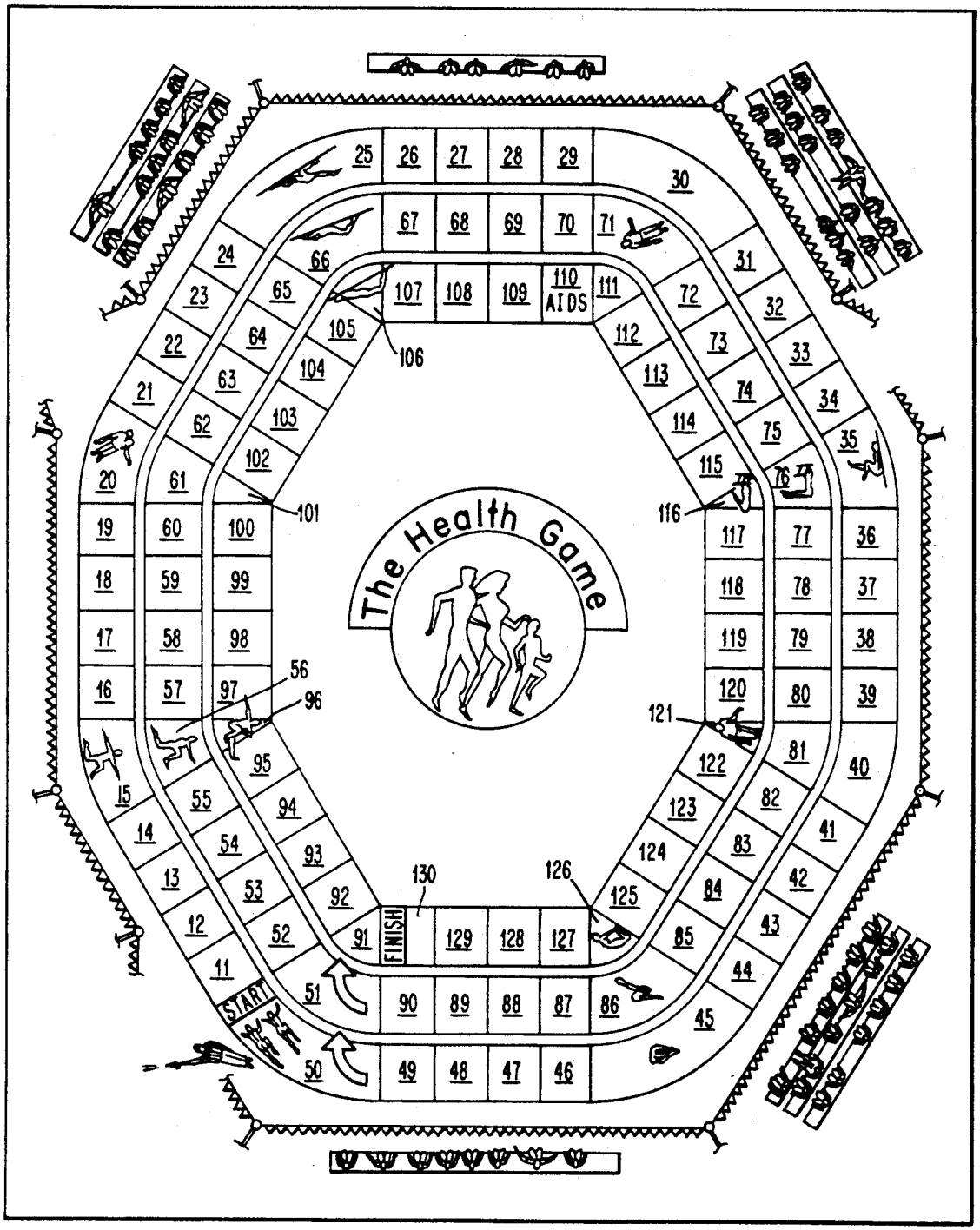
FIG. 1A shows a first surface of a playing board constructed in accordance with a preferred embodiment of the invention.

Reference is now made to the present preferred embodiments of the invention, examples of which are illustrated in the accompanying drawings, wherein like reference numerals indicate like elements throughout the several views.

Referring to FIG. 1A, a playing board for a health game is shown constructed in accordance with an embodiment of the present invention. The playing board includes a first playing surface defined on a base, and having a plurality of playing locations disposed contiguously on the first playing surface.

Figure 1B:
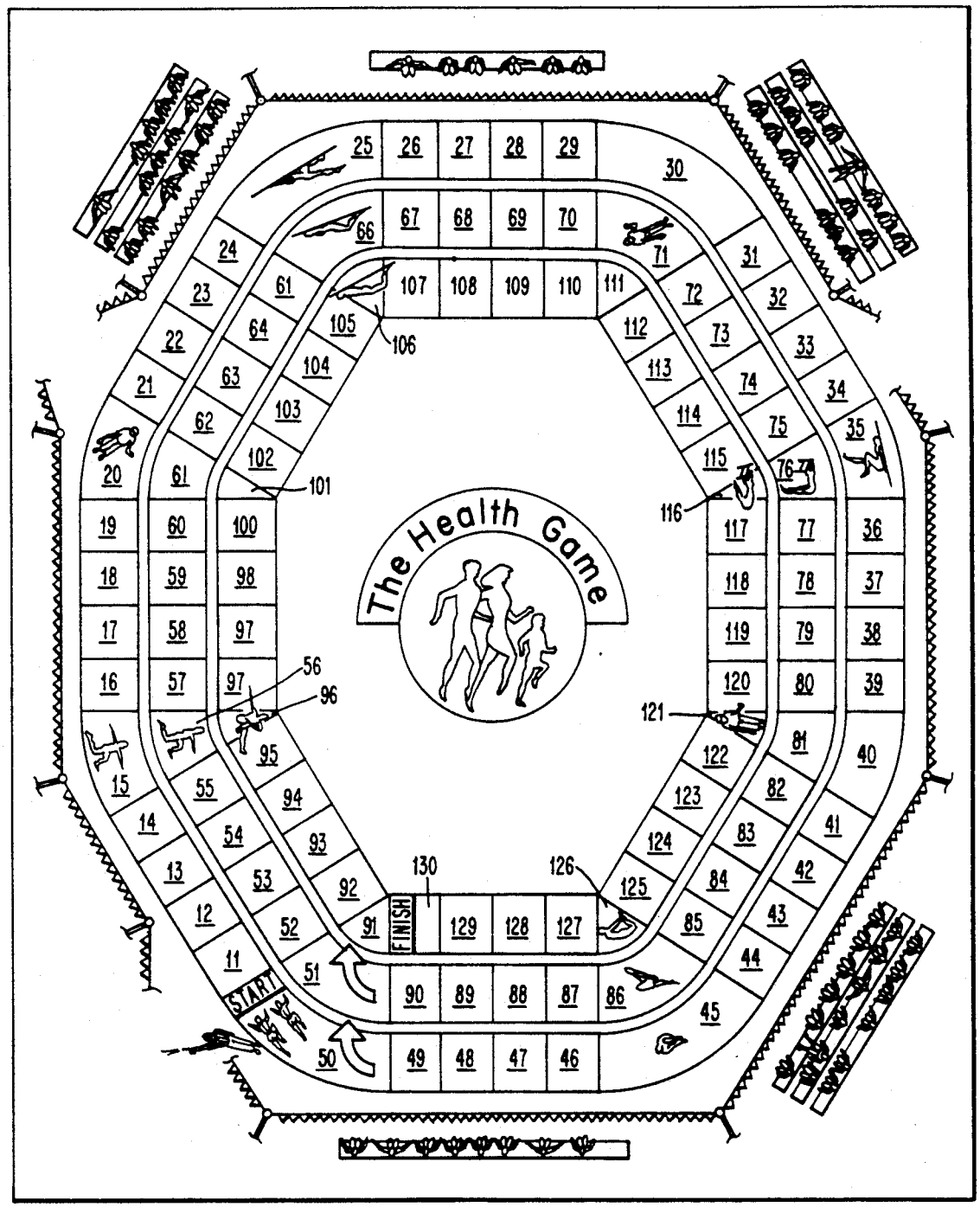
FIG. 1B shows a second surface of the playing board constructed in accordance with a preferred embodiment of the invention.

Referring to FIG. 1B, the reverse side of the playing board for the health game is shown constructed in accordance with an embodiment of the present invention, with the playing board including a second playing surface defined on the reverse side of the base, and having a plurality of playing locations disposed contiguously on the second playing surface.

The board game according the present invention includes manually manipulable means; a plurality of playing pieces, as illustrated in FIG. 2; a plurality of health question cards, as illustrated in FIG. 4; and a game board. The manually manipulable means bear indicia for making a chance selection, and may be embodied as a pair of dice, as shown in FIG. 3. Each of the plurality of playing pieces of FIG. 2 represents a player. The plurality of health question cards of FIG. 4 contain player questions. The manually manipulable means, typically a pair of conventional dice, but not forming part of the playing board, are provided for determining a player's move.

More particularly, as shown in FIG. 1A, a game board is provided comprising a first playing surface 9 thereon having a first series of playing locations, a second series of playing locations, and a third series of playing locations. The first series of playing locations is defined about the perimeter of the first playing surface of the game board in substantially contiguous relationship having the shape of an octagon. The first series of playing locations comprises a playing path in which the playing pieces are moved in discrete steps between successive locations.

The second series of playing locations is defined about the first playing surface in substantially contiguous relationship, having the shape of an octagon, and is located within the first series of playing locations. The second series of playing locations comprises a playing path in which the playing pieces are moved in discrete steps between successive locations. The first series of playing locations includes at least one location that a player whose piece lands thereon is to move to the second series of playing locations.

The third series of playing locations is defined about the first playing surface in substantially contiguous relation, having the shape of an octagon, and is located within the first and second series of playing locations. The third series of playing locations comprises a playing path in which the playing pieces are moved in discrete steps between successive locations. The second series of playing locations includes at least one location that a player whose piece lands thereon is to move to the third series of playing locations.

Playing locations include at least one location indicating that a player whose piece lands thereon contracts a health problem, as illustrated in FIG. 5A; at least one location indicating that player whose piece lands thereon obtains a health certificate card, as illustrated in FIG. 6; and at least one location indicating that a player whose piece lands thereon follows a game direction, as illustrated in FIG. 7.

The embodiment of the invention illustrated in FIG. 1A are provides a start location 50, a plurality of number locations and a finish location 130. Many of the numbered locations contain instructions to a participant whose playing piece lands on the numbered location. An exemplary listing of a set of suitable instruction is provided herein below:

| | | |
|---|---|---|
| 11. | START | |
| 12. | Drug Free | 500 Score Points |
| 13. | Stroke | 500 Penalty Points |
| 14. | Calcium Supplement | 200 Score Points |
| 15. | Exerciser | |
| 16. | Drug Abuser | 500 Penalty Points |
| 17. | Crisis Suicide Hotline | 1000 Score Points |
| 18. | Stress | 200 Penalty Points |
| 19. | Nonsmoker | 500 Score Points |
| 20. | Water Boy | |
| 21. | High Blood Pressure | 500 Penalty Points |
| 22. | Dental Hygiene & Checkup | 200 Score Points |
| 23. | Lung Cancer | 500 Penalty Points |
| 24. | Condoms | 1000 Score Points |
| 25. | Stretch Exerciser | |
| 26. | Diet Card 2 | 500 Score Points |
| 27. | Dental Hygiene & Checkup | 200 Score Points |
| 28. | Lung Cancer | 500 Penalty Points |
| 29. | Condoms | 1000 Score Points |
| 30. | ADVANCE 5 SPACES | |
| 31. | Diabetes | 500 Penalty Points |
| 32. | Iron Supplements | 200 Score Points |
| 33. | Drug Abuser | 500 Penalty Points |
| 34. | Seat Belts | 500 Score Points |
| 35. | Exerciser | |
| 36. | Suicidal | 1000 Penalty Points |
| 37. | Family Planning | 200 Score Points |
| 38. | Overweight | 200 Penalty Points |
| 39. | Seat Belts | 500 Score Points |
| 40. | LOSE 1 TURN | |

-continued

| | | |
|---|---|---|
| 41. | Anemia | 500 Penalty Points |
| 42. | Alcohol Free | 500 Score Points |
| 43. | Osteoporosis | 500 Penalty Points |
| 44. | Crisis Suicide Hotline | 1000 Score Points |
| 45. | Exerciser | |
| 46. | Automobile Injury | 500 Penalty Points |
| 47. | Alcohol Free | 500 Score Points |
| 48. | Unplanned Pregnancy | 200 Penalty Points |
| 49. | Diet Card 1 | |
| 50. | Start Block for Turning Lane | |
| 51. | LOSE 1 TURN | |
| 52. | Condoms | 1000 Score Points |
| 53. | Cavities | 500 Penalty Points |
| 54. | Vacation | 500 Score Points |
| 55. | Heart Disease | 500 Penalty Points |
| 56. | Exerciser | |
| 57. | Diet Card 3 | 500 Score Points |
| 58. | Alcohol Abuser | 500 Score Points |
| 59. | Vacation | 500 Score Points |
| 60. | Diverticular Disease | 500 Penalty Points |
| 61. | GO BACK 2 SPACES | |
| 62. | Nonsmoker | 500 Score Points |
| 63. | AIDS | 1000 Penalty Points |
| 64. | Drug Free | 500 Score Points |
| 65. | High Blood Pressure | 500 Penalty Points |
| 66. | Floor Exerciser | |
| 67. | Stroke | 500 Penalty Points |
| 68. | Calcium Supplement | 200 Score Points |
| 69. | Drug Abuser | 500 Penalty Points |
| 70. | Crisis Suicide Hotline | 1000 Score Points |
| 71. | REST STOP | |
| 72. | Stress | 500 Penalty Points |
| 73. | Nonsmoker | 500 Score Points |
| 74. | Diet Card 2 | 500 Score Points |
| 75. | Dental Hygiene & Checkup | 200 Score Points |
| 76. | Exerciser | |
| 77. | Lung Cancer | 500 Penalty Points |
| 78. | Condoms | 1000 Score Points |
| 79. | Diabetes | 500 Penalty Points |
| 80. | Iron Supplements | 200 Score Points |
| 81. | ADVANCE 4 SPACES | |
| 82. | Drug Abuser | 500 Penalty Points |
| 83. | Seat Belts | 500 Score Points |
| 84. | Suicidal | 1000 Penalty Points |
| 85. | Family Planning | 200 Score Points |
| 86. | Exerciser | |
| 87. | Overweight | 200 Penalty Points |
| 88. | Seat Belts | 500 Score Points |
| 89. | High Fiber Diet | 500 Score Points |
| 90. | Alcohol Fee | 500 Score Points |
| 91. | GO BACK 7 SPACES | |
| 92. | Osteoporosis | 500 Penalty Points |
| 93. | Crisis Suicide Hotline | 1000 Score Points |
| 94. | Automobile Injury | 500 Penalty Points |
| 95. | High Fiber Diet | 500 Score Points |
| 96. | Exerciser | |
| 97. | Unplanned Pregnancy | 200 Penalty Points |
| 98. | Diet Card 1 | 500 Score Points |
| 99. | Condoms | 1000 Score Points |
| 100. | Cavities | 200 Penalty Points |
| 101. | LOSE 1 TURN | |
| 102. | Vacation | 500 Score Points |
| 103. | Heart Disease | 500 Penalty Points |
| 104. | Diet Card 3 | 500 Score Points |
| 105. | Alcohol Abuser | 500 Penalty Points |
| 106. | Exerciser | |
| 107. | Vacation | 500 Score Points |
| 108. | Diverticular Disease | 500 Penalty Points |
| 109. | Nonsmoker | 500 Score Points |
| 110. | AIDS | 1000 Penalty Points |
| 111. | GO BACK 10 SPACES | |
| 112. | Drug Free | 500 Score Points |
| 113. | High Blood Pressure | 500 Penalty Points |
| 114. | Stroke | 500 Penalty Points |
| 115. | Calcium Supplement | 200 Score Points |
| 116. | Exerciser | |
| 117. | Drug Abuser | 500 Penalty Points |
| 118. | Crisis Suicide Hotline | 1000 Score Points |
| 119. | Stress | 500 Penalty Points |
| 120. | Nonsmoker | 500 Score Points |
| 121. | Water Boy | |
| 122. | Diet Card 2 | 500 Score Points |

-continued

| | | |
|---|---|---|
| 123. | Dental Hygiene & Checkup | 200 Score Points |
| 124. | Lung Cancer | 500 Penalty Points |
| 125. | Condoms | 1000 Score Points |
| 126. | Exerciser | |
| 127. | Diabetes | 500 Penalty Points |
| 128. | Iron Supplements | 200 Score Points |
| 129. | Anemia | 500 Penalty Points |

The start location 50 may also serve as a location where a player whose piece lands thereon is to move to the second series of playing locations at location 51, and location 51 also may serve as the location where a player whose piece lands thereon is to move to the third series of playing locations at location 91.

Interspersed among the numbered locations are a first plurality of locations indicating that a player whose piece lands thereon contracts a health problem, as illustrated in FIG. 5A. The first plurality of locations includes, but is not limited to, stroke 12, drug abuser 16, stress 18, high blood pressure 21, lung cancer 23, lung cancer 28, diabetes 31, drug abuser 33, suicidal 36, cavities 53, heart disease 55, alcohol abuser 58, diverticular disease 60, AIDS 63, high blood pressure 65, stroke 67, drug abuser 69, stress 72, diabetes 79, overweight 87, osteoporosis 92, automobile injury 94, unplanned pregnancy 97, and additional health problems as indicated above.

Interspersed among the numbered locations are a second plurality of playing locations indicating that a player whose piece lands thereon obtains a preventive health care certificate, as illustrated in FIG. 6. These playing locations include, but are not limited to, drug free 11, calcium supplement 14, non-smoker 19, condoms 24, dental hygiene and checkup 27, iron supplement 32, seat belts 34, family planning 37, alcohol free 42, vacation 54, non-smoker 62, family planning 85, high fiber diet 95, crisis suicide hotline 118, dental hygiene and checkup 123, and other locations as indicated above. In addition, also shown in FIG 1A are exerciser locations, as illustrated in FIG. 7, at locations 15, 25, 35, 45, 56, 66, 76, 86, 96, 106, 116, and 126. Water boy locations, as illustrated in FIG. 8, are also indicated at locations 20, 71, and 121. Additional locations may be included having game directions such as to move backwards or to advance, as illustrated in FIG. 9.

The health game of the present invention describes health problems for nearly all the ten leading causes of death in the United States, in a preferred embodiment. Leading authorities have defined preventive health care principles for specific health problems, and these concepts are set forth in the health game. Health problems and preventive actions are present in a special order to help facilitate the health education learning process in the present invention. The health game is played in the setting of a "track and field race game" where players move a total of three laps around the board, by throwing dice beginning at the start location 50 and ending at the finish location 130. There are a total of 116 game board locations which, in a preferred embodiment of the present invention, represent five categories: health problem locations, as illustrated in FIG. 5A; preventive health care locations, as illustrated in FIG. 10; exercise locations, as shown in FIG. 7; rest stop locations, as shown in FIG. 8; and game direction locations, as shown in FIG. 9.

As the players proceed around the game board, the players acquire penalty points and score points through penalty point cards, as illustrated in FIGS. 11A–11C, and through score point cards, as illustrated in FIGS. 12A–12C, respectively. At the end of the race, the player's acquired total number of penalty points are subtracted from the total number of score points. The player with the highest number of score points wins the game. Note that the winner of the game is not the player who finishes the race first, but rather the player who finishes the race with the highest number of score points. The player who finishes the race first, however, receives bonus score points.

The present invention utilizes dice, playing pieces, preventive health care certificates, score point cards, penalty point cards, health question cards, and match cards. According to the present invention, a player starts from the start location 50 and throws the dice. The player moves around the board and his options depend on which location the player's playing piece lands on. If the player lands on a preventive health care location, as illustrated in FIG. 9, then the player receives a preventive health care certificate, as illustrated in FIG. 6, to match the preventive health care location. The player receives score points as indicated in the preventive health care location.

According to the present invention, the health problem locations on the first playing surface include a location number, a health problem description, and a number indicating penalty points, as shown in FIG. 5A. If the player's playing piece lands on a health problem location, the player has two options. The first option, the player holding the appropriate preventive health care certificate matching the health problem will not receive penalty points and waits until the next turn. The second option, the player with the preventive health care certificate selects a health question card to earn more score points. If the player provides the correct response to the health question from the health question card, then the player earns double score points from the health problem location. If the player provides an incorrect response, then the player does not earn extra score points but no penalty points are received.

If the player lands on a health problem location, and the player is without the appropriate preventive health care certificate then the player has two choices. First, the player receives penalty points as indicated in the health problem location, and waits until the next turn. Second, the player may, alternatively, select a health question card to answer a health question. If the player provides the correct response to the health question then the player does not receive any penalty points from the health problem location but receives the score points on the health problem location. If, instead, the player provides an incorrect response to the health question, then the player receives double penalty points from the health problem location.

In order to determine the appropriate preventive health certificate for the health problem location, a player examines a match card. Score point cards are used to keep record of score points earned. Penalty points cards are used to keep record of penalty points received. To distinguish preventive health care locations from health problem locations, see the match card.

During the normal play of the game, a player throws dice and moves his playing piece by the appropriate number of locations according to the throw of the dice. If the playing piece lands on an exerciser picture, as illustrated in FIG. 7, then the player receives 50 score points. If the playing piece lands on a water boy location, as shown in FIG. 8, then this is a rest stop, and the player receives neither score points nor penalty points. If the playing piece lands on a game direction location, then the player must follow the directions indicated on the game direction location. Game direction locations include the directions to lose one turn, to go back ten locations, to advance forward a number of spaces, etc.

Below is the match card as according to the present invention.

MATCH CARD

| Games Locations HEALTH PROBLEM | Games Locations PREVENTIVE HEALTH | PREVENTIVE HEALTH CARE CERTIFICATE |
|---|---|---|
| A.I.D.S. | CONDOM | NO AIDS HEALTH CERTIFICATE |
| ALCOHOL ABUSER | ALCOHOL FREE | NO ALCOHOL CONSUMPTION HEALTH CERTIFICATE |
| ANEMIA | IRON SUPPLEMENT | IRON SUPPLEMENT HEALTH CERTIFICATE |
| AUTOMOBILE INJURY | SEAT BELTS | SEAT BELT HEALTH CERTIFICATE |
| CAVITIES | DENTAL HYGIENE & CHECKUP | DENTAL HYGIENE HEALTH CERTIFICATE |
| DIABETES | REDUCE FAT, CONTROL CALORIES, INCREASE STARCH AND FIBER | NO DIABETES HEALTH CERTIFICATE |
| DIVERTICULAR DISEASE | HIGH FIBER DIET | HIGH FIBER DIET HEALTH CERTIFICATE |
| DRUG ABUSER | DRUG FREE | DRUG FEE HEALTH CERTIFICATE |
| HEART DISEASE | REDUCE FACT, CONTROL CALORIES, REDUCE SODIUM | GOOD HEART HEALTH CERTIFICATE |
| HIGH BLOOD | REDUCE FACT, CONTROL CALORIES, REDUCE SODIUM | GOOD BLOOD PRESSURE HEALTH CERTIFICATE |
| LUNG CANCER | NONSMOKER | NONSMOKER HEALTH CERTIFICATE |
| OSTEOPOROSIS | CALCIUM SUPPLEMENT | CALCIUM SUPPLEMENT HEALTH CERTIFICATE |
| OVERWEIGHT | LOW CALORIE DIET or EXERCISE | GOOD WEIGHT HEALTH CERTIFICATE |

-continued

| MATCH CARD | | |
|---|---|---|
| Games Locations HEALTH PROBLEM | Games Locations PREVENTIVE HEALTH | PREVENTIVE HEALTH CARE CERTIFICATE |
| STRESS | VACATION or EXERCISE | VACATION CERTIFICATE or EXERCISE |
| SUICIDAL | CRISIS SUICIDE HOTLINE | HOTLINE HEALTH CERIFICATE |
| UNPLANNED PREGNANCY | FAMILY PLANNING | FAMILY PLANNING HEALTH CERTIFICATE |

A simpler version of the health game for younger children is provided in the present invention. As shown in FIG. 1B, the reverse side of the playing board for the health game is shown, with the playing board including a second playing surface 10 defined on the reverse side of the base, and having a first series of playing locations, a second series of playing locations, and a third series of playing locations on the second playing surface. The first series of playing locations is defined about the perimeter of the second playing surface of the game board in substantially contiguous relationship having the shape of an octagon. The first series of playing locations of the second playing surface comprises a playing path in which the playing pieces are moved in discrete steps between successive locations.

The second series of playing locations is defined about the second playing surface in substantially contiguous relationship, having the shape of an octagon, and is located within the first series of playing locations of the second playing surface. The second series of playing locations of the second playing surface comprises a playing path in which the playing pieces are moved in discrete steps between successive locations. The first series of playing locations of the second playing surface includes at least one location that a player whose piece lands thereon is to move to the second series of playing locations of the second playing surface.

The third series of playing locations is defined about the second playing surface in substantially contiguous relation, having the shape of an octagon, and is located within the first and second series of playing locations of the second playing surface. The third series of playing locations of the second playing surface comprises a playing path in which the playing pieces are moved in discrete steps between successive locations. The second series of playing locations on the second playing surface includes at least one location that a player whose piece lands thereon is to move to the third series of playing locations of the second playing surface.

The embodiment of the invention illustrated in FIG. 1B are provides a start location 50, a plurality of playing locations, as shown in FIG. 5B, and a finish location 130. In the simplified version of the health game, using the second playing surface of the playing board, as illustrated in FIG. 1B, the playing locations, as illustrated in FIG. 5B, contain location numbers but do not contain health problem descriptions, score points, penalty points, instructions in which the player contracts a health problem, or instructions in which the player receives a preventive health care certificate.

For the simplified version of the health game, a first player throws dice and moves his playing piece by the appropriate number of playing locations according to the throw of the dice. Upon landing on a playing location, the first player takes a health question card and answers the health question. If the first player provides a wrong answer, the first player goes backwards according to the roll of the dice, and the next player takes a turn and rolls the dice. However, if the first player provides a correct answer to the health question, the first player rolls the dice, advances according to the throw of the dice, takes another health question card, and answers the health question. If the first player answers the second health question card correctly, the first player rolls the dice, advances according to the roll of the dice, but the first player's turn then ends and the first player does not answer another health question until his next turn. However, if the first player provides a wrong answer to the second health question card, the first player goes backward according to the roll of the dice, and the next player takes a turn and rolls the dice. The winner is the first player to reach the finish line 130.

HEALTH QUESTION CARDS

A plurality of health question cards are also provided which are normally maintained in a face down, shuffled condition on either the first or the second playing surface depending on the version of the health game being played. The health question cards bear the following questions:

1. The largest body organ among the following are:
   a. Heart
   b. Liver
   c. Spleen
   Answer: b. Liver 2. The kidney functions in the body to:
   a. Filter the blood
   b. Regulate digestion of fluids
   c. Stimulate insulin secretion
   Answer: a. Filter the blood 3. Measles is usually a childhood disease and is:
   a. Not contagious
   b. Slightly contagious
   c. Highly contagious
   Answer: c. Highly contagious 4. Fever occurs when:
   a. Body temperature is above 98.6 F.
   b. Body temperature is 90.6 F.
   c. Sun bathing
   Answer: a. Body temperature is above 98.6 F.

5. AIDS is caused by a:
   a. Virus
   b. Bacteria
   c. Fungus
   Answer: a. Virus 6. Malaria is spread in Africa, Asia and South America by:
   a. Mosquito bites
   b. The sandfly c. Skin to skin contact
Answer: a. Mosquito bites 7. In less developed countries, the main cause of diarrhea is:
a. Soft food diets
b. Lack of clean drinking water
c. Breast milk
Answer: b. Lack of clean drinking water 8. In the United states, the most important factor associated with the death of babies under 1 year of age is:
a. Car accidents
b. Accidents in the home
c. Low birth weight
Answer: c. Low birth weight 9. Usually the first sign of pregnancy is:
a. A missed menstrual period
b. Increase in weight
c. Headaches
Answer: a. A missed menstrual period 10. The normal length of time a woman is pregnant is about
a. 39 Weeks
b. 31 Weeks
c. 49 Weeks
Answer: a. 39 Weeks 11. Pregnant women who are alcoholics may have a baby born with:
a: AIDS
b: Diabetic syndrome
c: Fetal alcohol syndrome
Answer: c. Fetal alcohol syndrome 12. The ideal milk choice for infants is:
a. Cows milk
b. Human milk
c. Goat milk
Answer: b. Human milk 13. Obesity is cause by:
a. Excess cholesterol
b. Excess calories
c. Serotonin secretion
Answer: b. Excess calories 14. Childhood obesity can lead to:
a. Adult obesity
b. Achalasia
c. Esophagitis
Answer: a. Adult obesity 15. The flour that has the highest amount of vitamin E is:
a. Soybean flour
b. Rye flour
c. Whole wheat flour
Answer: c. Whole wheat flour 16. Liver is an excellent source of:
a. Vitamin K
b. Vitamin E
c. Vitamin A
Answer: c. Vitamin A 17. Oranges, grapefruit and lemons are rich sources of:
a. Vitamin E
b. Vitamin A
c. Vitamin C
Answer: c. Vitamin C 18. The vitamin that is formed in the human intestinal tract is:
a. Vitamin D
b. Vitamin B1
c. Vitamin K
Answer: c. Vitamin K 19. Additional vitamin K is needed by the person who is taking:
a. Antihistamines
b. Aspirin
c. Antibiotics
Answer: c. Antibiotics 20. Carrots are a good source of:
a. Vitamin B1
b. Carotene
c. Vitamin B2
Answer: b. Carotene 21. Vitamin A has a role in:
a. Taste
b. Hearing
c. Vision
Answer: c. Vision 22. The vitamin to prevent night blindness is:
a. Vitamin C
b. Vitamin A
c. Vitamin D
Answer: a. Vitamin A 23. The vitamin to prevent rickets is:
a. Vitamin C
b. Vitamin A
c. Vitamin D
Answer: c. Vitamin D 24. Albumin is a type of protein found in:
a. Wheat
b. Corn
c. Egg
Answer: c. Egg 25. The best source of Vitamin C is:
a. Citrus fruit
b. Sugar
c. Fish
Answer: a. Citrus fruit 26. The vitamin folic acid is found in:
a. Liver
b. White flour
c. Irish potatoes
Answer: a. Liver 27. The best food source of Vitamin B12 is:
a. Vegetables
b. Bread
c. Liver
Answer: c. Liver 28. The best food source of the Vitamin Biotin is:
a. Cereal product
b. Wheat flour
c. Liver
Answer: c. Liver 29. The best food source of Vitamin K is:
a. Spinach
b. Apple source
c. Corn
Answer: a. Spinach 30. Which food has the highest iron content?:
a. Chicken
b. Rice
c. Kidney Beans
Answer: c. Kidney beans 31. Which food type has the highest amount of salt?:
a. Canned food
b. Frozen food
c. Fresh food
Answer: a. Canned food 32. Potato chips are high in:
a. Potassium
b. Sodium
c. Zinc
Answer: b. Sodium 33. Broccoli is an excellent source of:
a. Calcium
b. Sulphur
c. Copper
Answer: a. Calcium 34. The dairy product that has the highest amount of salt is:
a. Butter
b. Processed cheese
c. Yogurt
Answer: b. Processed cheese 35. A protein that is soluble in water and made from collagen is:
a. Casein
b. Ovalbumin
c. Gelatin
Answer: c. Gelatin 36. Mackerel has:
a. Low protein
b. Low fat
c. High fat
Answer: c. High fat 37. The protein found in milk is:
a. Lactose
b. Colloid
c. Lactalbumin
Answer: c. Lactalbumin 38. Vitamin C is added to canned fruit to:
a. Improve texture
b. Preserve it
c. Aid in digestion
Answer: b. Preserve it 39. Anemia is due to a lack of:
a. Iron
b. Sulfur
c. Copper
Answer: a. Iron 40. Wernicke's disease is related to a deficiency of:
a. Vitamin D
b. Vitamin B1
c. Vitamin C
Answer: b. Vitamin B1

41. Gingivitis is due to a deficiency of:
a. Vitamin C
b. Vitamin B6
c. Vitamin B2
Answer: a. Vitamin C 42. Xerophthalmia is due to a deficiency of:
a. Vitamin A
b. Vitamin K
c. Vitamin B1
Answer: a. Vitamin A 43. Vitamin B12 is not found in:
a. Animal foods
b. Plant foods
Answer: b. Plant foods 44. Pellagra is due to a deficiency of:
a. Vitamin B1
b. Vitamin B2
c. Vitamin B3
Answer: c. Vitamin B3

45. Vitamin B1 is called:
a. Thiamine
b. Riboflavin
c. Niacin
Answer: a. Thiamine 46. Vitamin B2 is called:
a. Riboflavin
b. Thiamine
c. Niacin
Answer: a. Riboflavin 47. Vitamin B3 is called:
a. Riboflavin
b. Thiamine
c. Niacin
Answer: c. Niacin 48. Goiter is due to a deficiency of the nutrient:
a. Zinc
b. Iron
c. Iodine
Answer: c. Iodine 49. Osteoporosis may be due to a deficiency of:
a. Vitamin C
b. Vitamin E
c. Calcium
Answer: c. Calcium 50. A nutrient commonly deficient in the American diet is:
a. Calcium b. Protein
c. Iron
Answer: c. Iron 51. The most commonly used grain in the world is:
a. Wheat
b. Rice
c. Corn
Answer: b. Rice 52. An elevated blood sugar level is associated with:
a. Hepatitis
b. Coronary artery disease
c. Diabetes mellitus
Answer: c. Diabetes mellitus 53. Cramps during exercise are associated with:
a. Muscle spasm
b. Aerobic oxidation
c. Lactic acid
Answer: c. Lactic acid 54. To reduce dental decay:
a. Increase Vitamin D
b. Decrease concentrated sweets
c. Increase calcium
Answer: b. Decrease concentrated sweets 55. The best food source of dietary fiber is:
a. Sprouts and seeds
b. Lettuce and tomatoes
c. Beans and whole grain breads
Answer: c. Beans and whole grain breads 56. The food lowest in fiber is:
a. Lettuce
b. Celery
c. Macaroni
Answer: c. Macaroni 57. An example of a starch food that has empty calories is:
a. Pizza
b. Candy
c. Bread
Answer: b. Candy 58. The oil that contains the highest amount of polyunsaturated fatty acid is:
a. Corn Oil
b. Safflower Oil
c. Soybean Oil
Answer: b. Safflower Oil 59. A good source of lecithin is:
a. Egg yolk
b. Egg white
c. Milk
Answer: a. Egg yolk 60. The cheese that has the least fat content is:
a. Swiss cheese
b. Muenster cheese
c. Sapsago cheese
Answer: c. Sapsago cheese 61. The food that has the highest concentration of biological protein:
a. Beef
b. Egg
c. Fish
Answer: b. Egg 62. Kwashiorkor is a dietary deficiency of:
a. Carbohydrates
b. Protein
c. Fat
Answer: b. Protein 63. Osteoporosis is a disease that results in a reduction of:
a. Calcium in the bone
b. Total bone mass
c. Blood calcium
Answer: b. Total bone mass 64. To consume excess raw egg whites leads to a deficiency of the vitamin:
a. Pyridoxine
b. Biotin
c. Folic acid
Answer: b. Biotin 65. Cataracts may be associated with:
a. High blood pressure
b. Diabetes
c. Respiratory illness
Answer: b. Diabetes 66. Teenage mothers have:
a. 1 out of every 4 low birth weight infants
b. 1 out of every 3 low birth weight infants
c. 1 out of every 5 low birth weight infants
Answer: a. 1 out of every 4 low birth weight infants 67. Studies have been shown that some infants may be born smaller than normal due to:
a. Lack of the proper enzyme
b. Poor nutritional status of the mother
c. Lack of aerobic exercises
Answer: b. Poor nutritional status of the mother 68. Some scientists have found that infants of women with heroin or methadone addiction are:
a. Slightly overweight at birth
b. Underweight at birth
c. Neither overweight or underweight
Answer: b. Underweight at birth 69. Mothers who are heavy smokers appear to give to their unborn babies:
a. Higher concentrations of carbon dioxide
b. Higher concentrations of carbon monoxide
c. Higher concentrations of oxygen
Answer: b. Higher concentrations of carbon monoxide 70. Premature infants are susceptible to:
a. Fetal alcohol syndrome
b. Respiratory distress syndrome
c. Sleeplessness
Answer: b. Respiratory distress syndrome 71. The number of newborns affected with respiratory distress syndrome each year are:
a. 4,000 b. 40,000
c. 400,000
Answer: b. 40,000

72. Hypoglycemia is a condition of:
a. Low blood sugar
b. High blood sugar
c. Low blood calcium
Answer: a. Low blood sugar 73. Jaundice is caused by an excess of:
a. Hemoglobin in the blood
b. Carbon monoxide
c. Bile pigment in the blood
Answer: c. Bile pigment in the blood 74. Hyperbilirubinemia is:
a. Increased levels of bilirubin in the blood
b. Decreased levels of bilirubin in the blood
c. Neither of the above
Answer: a. Increased levels of bilirubin in the blood 75. To stop the development of hyperbilirubinemia in a newborn, it is necessary to:
a. Increase oxygen for long periods of time
b. Expose the infant to artificial light for long periods of time
c. Increase trace metal consumption
Answer: b. Expose infant to artificial light for long periods of time 76. Megaloblastic anemia is due to a deficiency of:
a. Vitamin C
b. Folic Acid
c. Vitamin K
Answer: b. Folic Acid 77. Anorexia nervosa is a disorder of:
a. Iron deficiency
b. Newborns
c. Self-starvation
Answer: c. Self-starvation 78. To help a patient with anorexia nervosa it is necessary to have:
a. Psychotherapy
b. Increase water consumption
c. Increase exercise
Answer: a. Psychotherapy 79. Out of every 200 American girls between the ages of 12 and 18:
a. 10 will develop anorexia
b. 1 will develop anorexia
c. 15 will develop anorexia
Answer: b. 1 will develop anorexia 80. Most patients with anorexia nervosa are:
a. Male
b. Female
Answer: b. Female 81. A test called an electroencephalogram may be given to:
a. Measure heart rate
b. Measure oxygen levels
c. Measure brain activity
Answer: c. Measure brain activity 82. Thermography is an experimental technique for diagnosing:
a. Headaches
b. Lung cancer
c. Diabetes
Answer: a. Headaches 83. The four different types of headaches are vascular headaches, muscle contraction headaches, traction headaches, inflammatory headaches:
a. True
b. False
Answer: a. True 84. Migraines are a type of:
a. Traction headache
b. Inflammatory headache
c. Vascular headache
Answer: c. Vascular headache 85. Migraine headaches are usually characterized by severe pain on both sides of the head, upset stomach and at times disturbed vision:
a. True
b. False
Answer: a. True 86. Classic migraines start on one side of the head but may eventually spread to the other side. An attack lasts:
a. 1 to 2 days
b. 1 to 2 seconds
c. 1 to 2 minutes
Answer: a. 1 to 2 days 87. Common migraines can cause mood changes, fatigue and unusual retention of fluids:
a. True
b. False
Answer: a. True 88. A common migraine attack can last:
a. 3 or 4 days
b. 3 or 4 minutes
c. 3 or 4 weeks
Answer: a. 3 or 4 days 89. A migraine headache can strike as often as several times a week or as rarely as once every few years:
a. True
b. False
Answer: a. True 90. Migraines are more common in adult men than adult women:
a. True
b. False
Answer: b. False 91. One of the most commonly used drugs for the relief of classic and common migraines are:
a. Neuraminidase
b. Ergotamine
c. Putrescine
Answer: b. Ergotamine 92. A tension headache is a severe but temporary form of muscle contraction headache:
a. True
b. False
Answer: a. True 93. Brain tumors are diagnosed in about:
a. 11,000 people every year
b. 111,000 people every year
c. 11,000,000 people every year
Answer: a. 11,000 people every year 94. According to a health survey, the number of children age 16 and under who experience migraines and other vascular headaches are:
a. Nearly 100,000
b. Over a million
c. 25 thousand
Answer: a. Over a million 95. Phenobarbital and cyproheptadine are the names of drugs used to treat migraines in children:
a. True
b. False
Answer: a. True 96. Infarct strokes are usually more severe than hemorrhagic strokes:
a. True
b. False
Answer: b. False 97. Unlike other organs of the body, the brain cannot store energy. It depends upon a continuous supply of fresh blood pumped to it by the heart:
a. True
b. False
Answer: a. True 98. About 25% of the blood the heart pumps goes to the brain:
a. True
b. False
Answer: a. True 99. In the most common form of stroke, the blood flow to the brain is blocked or becomes clogged:
a. True
b. False
Answer: a. True 100. The most common warning signs of a stroke are tingling in the limbs, temporary blindness, and difficulty of speech:
a. True
b. False
Answer: a. True 101. A medical technique used to take detailed pictures of the arteries of the brain is:
a. Arteriogram
b. Cardiogram
c. Blood glucose test
Answer: a. Arteriogram 102. An anticoagulant is:
a. Substance that increases blood clotting
b. a neurotransmitter
c. Substance that reduces blood clotting
Answer: c. Substance that reduces blood clotting 103. The brain is divided into
a. 3 Hemispheres
b. 2 Hemispheres
c. 4 Hemispheres
Answer: b. 2 Hemispheres 104. Aphasia is the loss of the ability to make sense of languages including inability to understand printed words:
a. True
b. False
Answer: a. True 105. Influenza is a:
a. Fungus
b. Bacteria
c. Virus
Answer: c. Virus 106. Flu and pneumonia constitutes the:
a. 5th leading cause of death in the U.S.
b. 6th leading cause of death in the U.S.
c. 7th leading cause of death in the U.S.
Answer: b. 6th leading cause of death in the U.S.

107. Rye's syndrome develops in a small number of children and adolescents who are recovering from flu:
a. True
b. False
Answer: a. True 108. Scientists have classified flu viruses into three type - A, B and C:
a. True
b. False
Answer: a. True 109. The first flu virus was identified in the 1930's:
a. True
b. False
Answer: a. True 110. When a virus attaches to a cell in a healthy person, the virus stimulates the person's immune cells to produce:
a. Antibodies
b. Antigens
c. Hemagglutinin
Answer: a. Antibodies 111. Different antibodies are produced in response to each strain of virus:
a. True
b. False
Answer: a. True 112. Viruses for vaccine production are grown in chicken eggs and then inactivated with a chemical so that they are no longer infectious:
a. True
b. False
Answer: a. True 113. In 1987, the people estimated to be infected with the AIDS virus in the United States was:
a. 500,000
b. 250,000
c. 1,500,000
Answer: c. 1,500,000

114. AIDS transmitted by:
a. Needle sharing
b. Casual social contact
c. Sneezing and coughing
Answer: a. Needle sharing 115. Dogs, cats and domestic animals are a source of infection for the HIV virus:
a. True
b. False
Answer: b. False 116. Dysmenorrhea is the medical term for:
a. Opportunistic infection
b. Backaches
c. Painful menstruation
Answer: c. Painful menstruation 117. Otosclerosis is:
a. A Hereditary hearing problem
b. A blood clot
c. A blood disease
Answer: a. Hereditary hearing problem 118. The number of Americans either totally deaf or suffering significant hearing loss are approximately:
a. 20 thousand
b. 6 million
c. 100 thousand
Answer: b. 6 million 119. A child 4 years of age has a vocabulary of:
a. About 200–300 words
b. About 100–150 words
c. About 300–500 words
Answer: a. About 200–300 words 120. AIDS stands for:
a. Acquired Infection Disease Syndrome
b. Acquired Immune Development Syndrome
c. Acquired Immune Deficiency Syndrome
Answer: c. Acquired Immune Deficiency Syndrome 121. The forebrain is the largest area of the brain and helps to regulate functions like:
a. Information about sight and sound
b. Temperature and blood pressure
c. Controlling of breathing and heartbeat
Answer: b. Temperature and blood pressure 122. The midbrain regulates:
a. Information about sight and sound
b. Controlling of breathing and heartbeat
c. Temperature and blood pressure
Answer: a. Information about sight and sound 123. The hindbrain regulates:
a. Information about sight and sound
b. Controlling of breathing and heartbeat
c. Temperature and blood pressure
Answer: b. Controlling of breathing and heartbeat 124. The hypothalamus is the brain's emotion center that makes you feel exhilarated, angry or depressed:
a. True
b. False
Answer: a. True 125. Allergy is a disorder of the:
a. Skeletal system
b. Immune system
c. Circulatory system
Answer: b. Immune system 126. When a person has an allergy they have:
a. No reaction to environmental substances
b. Hyposensitivity to specific substances
c. Hypersensitivity to specific substances
Answer: c. Hypersensitivity to specific substances 127. Asthma is an obstruction of:
a. Airways into the lungs
b. The blood vessels
c. Passage of food from the stomach
Answer: a. Airways into the lungs 128. To treat allergies, which of the following are used?:
a. Diuretic therapies
b. Excessive sodium intake
c. Antihistamines
Answer: c. Antihistamines 129. Chronic allergis rhinitis, a disorder of the nasal mucosa, affects:
a. Thousands of Americans
b. Hundreds of Americans
c. Millions of Americans
Answer: c. Millions of Americans 130. A virus that causes AIDS is:
a. HIV
b. IHV
c. VIH
Answer: a. HIV 131. Genital warts, syphilis, and gonorrhea are all examples of:
a. Mental disorders
b. Sexually transmitted diseases
c. Tropical diseases
Answer: b. Sexually transmitted diseases 132. Tropical diseases, especially those caused by parasites, afflict nearly:
a. One billion people in the world
b. One million people in the world
c. 100 million people in the world
Answer: a. One billion people in the world 133. Leishmaniasis is a skin disease caused by:
a. Sexual contact
b. The bite of the sand-fly
c. The bite of a mosquito
Answer: b. The bite of the sand-fly 134. A person is considered to have high blood cholesterol beginning at:
a. 190 mg/dl b. 240 mg/dl
c. 130 mg/dl
Answer: b. 240 mg/dl 135. Glaucoma is an eye disease. To guard against visual loss, people should have regular eye examinations:
a. True
b. False
Answer: a. True 136. Glaucoma is an eye disease and usually begins in:
a. Early childhood
b. Adolescence
c. Middle age or later
Answer: c. Middle age or later 137. Glaucoma affects:
a. 100,000 adult Americans
b. 6 million adult Americans
c. 20 million adult Americans
Answer: b. 6 million adult Americans 138. Cholesterol is formed in the:
a. Liver
b. Gallbladder
c. Pancreas
Answer: a. Liver 139. The age group among automobile drivers in which the fewest fatal accidents occur per miles driven is:
a. 25 to 29 years
b. 45 to 49 years
c. 50 to 54 years
Answer: b. 45 to 49 years 140. The site of the greatest number of non-athletic injuries in colleges and universities is:
a. Dormitories
b. Laboratories
c. Auditoriums
Answer: a. Dormitories 141. Transportation is most dangerous in:
a. Automobiles
b. Trains
c. Air flights
Answer: a. Automobiles 142. For accidental poisoning in children under 5 years of age, the most frequently ingested substance is:
a. Bleach
b. Aspirin
c. Detergents
Answer: b. Aspirin 143. The leading of fatal home accidents is:
a. Firearms
b. Poisonings
c. Falls
Answer: c. Falls 144. Accidental death rates are higher in:
a. Males
b. Females
Answer: a. Males 145. The part of the body most frequently injured in disabling injuries:
a. Thumbs and fingers
b. Head
c. Trunk
Answer: c. Trunk 146. Eye screening programs to prevent blindness in adults is primarily for early detection of:
a. Glaucoma
b. Myopia
c. Astigmatism
Answer: a. Glaucoma 147. Skin Cancer may arise or result from:
a. Senile keratosis
b. Radium burns
c. All of the above
Answer: c. All of the above 148. To detect the toxin of botulism in foods by:
a. Odor
b. Taste
c. Both odor and taste
Answer: c. Both odor and taste 149 A factor influencing accident rates in industry is:
a. Type of occupation
b. Fatigue
c. Personality make-up
Answer: b. Fatigue 150. What is a vaccine?:
a. A product that will give protection against a certain disease
b. A respiratory disease
c. A germ
Answer: a. A product that will give protection against a certain disease 151. Rabies is a disease spread by:
a. Humans
b. Animals
c. Plants
Answer: b. Animals 152. When a person is bitten by an animal with rabies, he should:
a. Take aspirin
b. Lay down and rest
c. Go immediately to a physician for a vaccine
Answer: c. Go immediately to a physician for a vaccine 153. For minor first degree burns, to help ease the pain and lessen damage caused by a minor burn, put the burned part at once in:
a. Warm water
b. Cold water
c. Hot water
Answer: b. Cold water 154. Neurology is a branch of medical science that deals with the:
a. Nervous system
b. Heart
c. Lungs
Answer: a. Nervous system 155. A stroke is a:

a. Sudden loss of brain function
b. Type of ultraviolet radiation
c. Infection disease
Answer: a. Sudden loss of brain function 156. The brain is made up of:
a. Thousands of nerve cells
b. Millions of nerve cells
c. Billions of nerve cells
Answer: c. Billions of nerve cells 157. The human brain weighs about:
a. 1 pound
b. 3 pounds
c. 5 pounds
Answer: b. 3 pounds 158. The biggest and main portion of the brain is called the:
a. Carotid
b. Enteritis
c. Cerebrum
Answer: c. Cerebrum 159. Headaches affect about:
a. 40 thousand Americans
b. 40 million Americans
c. 400 thousand Americans
Answer: b. 40 million Americans 160. Hypertension is:
a. The name of a plant species
b. Persistently high blood pressure
c. A sexually transmitted disease
Answer: b. Persistently high blood pressure 161. In adults, it is generally agreed that high blood pressure is:
a. 140/90
b. 120/80
c. 95/60
Answer: a. 140/90

162. Senses of smell and possibly taste:
a. Decrease with age
b. Increase with age
c. Do not change with age
Answer: a. Decrease with age 163. The most common psychological factor affecting appetite is:
a. Hallucination
b. Depression
c. Schizophrenia
Answer: b. Depression 164. Compared to other adults, older Americans have a:
a. Higher economic status
b. Equal economic status
c. Lower economic status
Answer: c. Lower economic status 165. Compared to younger adults, older persons have:
a. Lower calorie intake
b. Higher calorie intake
c. Equal calorie intake
Answer: a. Lower calorie intake 166. Compared to younger persons, older persons especially have a higher occurrence of:
a. Obesity
b. Fractures
c. High blood pressure
Answer: b. Fractures 167. Alzheimer's disease is a:
a. Neurodegenerative syndrome
b. Heart disease
c. Lung disease
Answer: a. Neurodegenerative syndrome 168. Alzheimer's disease affects:
a. 100,000 Americans
b. 20,000 Americans
c. 2 to 3 million Americans
Answer: c. 2 to 3 million American It will be appreciated by those familiar with the art that the game described herein above is not limited to the playing according to the above described set of rules but may be played with any suitable set of rules or procedures, that rules may be devised for the game which may or may not incorporate the use of the playing cards as indicated herein, and that the game may be played without the use of the health cards as indicated herein.

In summary, it will be appreciated that the game described herein is not limited to the specific embodiment shown and described herein and above, but rather defined only by the claims which follow. Additionally, it will be apparent to those skilled in the art that various modifications can be made to the health game of the instant invention without departing from the scope or spirit of the invention and it is intended that the present invention cover modifications and variations of the health game provided they come within the scope of the appended claims and their equivalent.

I claim:

1. A game board comprising:

manually manipulable means bearing indicia for making a chance selection;

a plurality of playing pieces each representing a player;

a plurality of health question cards containing player questions;

a game board having a first playing surface and a second playing surface thereon;

wherein the first playing surface of said game board includes:

a first series of playing locations defined about the first playing surface in substantially contiguous relationship having the shape of an octagon, comprising a playing path wherein said playing pieces are moved in discrete steps between successive locations;

a second series of playing locations defined about the first playing surface in substantially contiguous relationship having the shape of an octagon, and located within said first series of playing locations of the first playing surface, comprising a playing path wherein said playing pieces are moved in discrete steps between successive locations, and wherein said first series of playing locations of the first playing surface include at least one location that a player whose piece lands thereon is to move to the second series of playing locations of the first playing surface; and a third series of playing locations defined about the first playing surface in substantially contiguous relationship having the shape of an octagon, and located within said first and second series of playing locations of the first playing surface, comprising a playing path wherein said playing pieces are moved in discrete steps between successive locations, and wherein said second series of playing locations of the first playing surface include at least one location that a player whose piece lands thereon is to move to the third series of playing locations;

wherein said first, second and third series of playing locations of the first playing surface include a first plurality of locations indicating that a player whose piece lands thereon contracts a health problem and a second plurality of locations indicating that a player whose piece lands thereon obtains a preventive health care certificate indicating attributes of health which may be used to avoid a health penalty; and wherein the second playing surface of said game board includes:

a first series of playing locations defined about the second playing surface in substantially contiguous relationship having the shape of an octagon, comprising a playing path wherein said playing pieces are moved in discrete steps between successive locations;

a second series of playing locations defined about the second playing surface in substantially contiguous relationship having the shape of an octagon, and located within said first series of playing locations of the second playing surface, comprising a playing path wherein said playing pieces are moved in discrete steps between successive locations, and wherein said first series of playing locations of the second playing surface include at least one location that a player whose piece lands thereon is to move to the second series of playing locations of the second playing surface; and a third series of playing locations defined about the second playing surface in substantially contiguous relationship having the shape of an octagon, and located within said first and second series of playing locations of the second playing surface, comprising a playing path wherein said playing pieces are moved in discrete steps between successive locations, and wherein said second series of playing locations of the second playing surface include at least one location that a player whose piece lands thereon is to move to the third series of playing locations of the second playing surface.

2. A board game comprising:

manually manipulable means bearing indicia for making a chance selection;

a plurality of playing pieces each representing a player;

a game board having a first playing surface and a second playing surface thereon;

wherein the first playing surface includes:

a first series of playing locations defined about the first playing surface in substantially contiguous relationship comprising a playing path in which said playing pieces are moved in discrete steps between successive locations;

a second series of playing locations defined about the first playing surface in substantially contiguous relationship and located within said first series of playing locations, comprising a playing path wherein said playing pieces are moved in discrete steps between successive locations;

a third series of playing locations defined about the first playing surface in substantially contiguous relationship and located within said first and second series of playing locations, comprising a playing path wherein said playing pieces are moved in discrete steps between successive locations;

wherein said first, second and third series of playing locations of the first playing surface include a first plurality of locations indicating that a player whose piece lands thereon contracts a health problem and a second plurality of locations indicating that a player whose piece lands thereon obtains a preventive health care certificate indicating attributes of health which may be used to avoid a health penalty; and wherein the second playing surface includes:

a first series of playing locations defined about the second playing surface in substantially contiguous relationship comprising a playing path in which said playing pieces are moved in discrete steps between successive locations;

a second series of playing locations defined about the second playing surface in substantially contiguous relationship and located within said first series of playing locations, comprising a playing path wherein said playing pieces are moved in discrete steps between successive locations; and a third series of playing locations defined about the second playing surface in substantially contiguous relationship and located within said first and second series of playing locations, comprising a playing path wherein said playing pieces are moved in discrete steps between successive locations.

3. The board game as set forth in claim 2 further comprising:

a plurality of health question cards containing player questions related to health.

4. The board game as set forth in claim 2, wherein said first series of playing locations of the first playing surface includes at least one location that a player whose piece lands thereon is to move to the second series of playing locations of the first playing surface; and wherein said first series of playing locations of the second playing surface includes at least one location that a player whose piece lands thereon is to move to the second series of playing locations of the second playing surface.

5. The board game as set forth in claim 4, wherein said second series of playing locations of the first playing surface includes at least one location that a player whose piece lands thereon is to move to the third series of playing locations of the first playing surface; and wherein said second series of playing locations of the second playing surface includes at least one location that a player whose piece lands thereon is to move to the third series of playing locations of the second playing surface.

6. The board game as set forth in claim 1 further comprising:

a match card containing a plurality of health problems, a plurality of preventive health care methods, and a plurality of preventive health care certificates.

7. A board game comprising:

manually manipulable means bearing indicia for making a chance selection;

a plurality of playing pieces each representing a player;

a game board having a first playing surface and a second playing surface thereon;

wherein the first playing surface includes:

a first series of playing locations defined about the first playing surface in substantially contiguous relationship having the shape of an octagon, comprising a playing path wherein said playing pieces are moved in discrete steps between successive locations;

a second series of playing locations defined about the first playing surface in substantially contiguous relationship having the shape of an octagon, and located within said first series of playing locations of the first playing surface, comprising a playing path wherein said playing pieces are moved in discrete steps between successive locations;

a third series of playing locations defined about the first playing surface in substantially contiguous relationship having the shape of an octagon, located within said first and second series of playing locations of the first playing surface, comprising a playing path wherein said playing pieces are moved in discrete steps between successive locations;

at least one location on the first playing surface indicating that a player whose piece lands thereon obtains a preventive health care certificate indicating attributes of health which may be used to avoid a health penalty;

at least one location on the first playing surface indicating that a player whose piece lands thereon follows a game direction;

wherein said first, second and third series of playing locations of the first playing surface include at least one location indicating that a player whose piece lands thereon contracts a health problem; and wherein the second playing surface includes:

a first series of playing locations defined about said second playing surface in substantially contiguous relationship having the shape of an octagon, comprising a playing path wherein said playing pieces are moved in discrete steps between successive locations;

a second series of playing locations defined about said second playing surface in substantially contiguous relationship having the shape of an octagon, and located within said first series of playing locations of the second playing surface, comprising a playing path wherein said playing pieces are moved in discrete steps between successive locations; and a third series of playing locations defined about said second playing surface in substantially contiguous relationship having the shape of an octagon, located within said first and second series of playing locations of the second playing surface, comprising a playing path wherein said playing pieces are moved in discrete steps between successive locations.

8. The board game as set forth in claim 7 further comprising:

a plurality of health question cards indicating attributes of health.

9. The board game as set forth in claim 7, wherein said second series of playing locations of the first playing surface includes at least one location that a player whose piece lands thereon is to move to the second series of playing locations of the first playing surface; and wherein said second series of playing locations of the second playing surface includes at least one location that a player whose piece lands thereon is to move to the second series of playing locations of the second playing surface.

10. The board game as set forth in claim 9, wherein said second series of playing locations of the first playing surface includes at least one location that a player whose piece lands thereon is to move to the third series of playing locations of the first playing surface; and wherein said second series of playing locations of the second playing surface includes at least one location that a player whose piece lands thereon is to move to the third series of playing locations of the second playing surface.

11. The board game as set forth in claim 2 further comprising:

a match card containing a plurality of health problems, a plurality of preventive health care methods, and a plurality of preventive health care certificates.

12. The board game as set forth in claim 7 further comprising:

a match card containing a plurality of health problems, a plurality of preventive health care methods, as a plurality of preventive health care certificates.

13. A board game comprising:

manually manipulable means bearing indicia for making a chance selection;

a plurality of playing pieces each representing a player;

a game board having a first playing surface and a second playing surface thereon;

wherein the first playing surface includes:

a series of playing locations defined about said playing surface in substantially contiguous relationship having the shape of an octagon comprising a playing path wherein said playing pieces are moved in discrete steps between successive locations;

at least one location of said series of playing locations on the first playing surface indicating that a player whose piece lands thereon contracts a health problem;

at least one location of said series of playing locations on the first playing surface indicating that a player whose piece lands thereon obtains a preventive health care certificate indicating attributes of health; and at least one location of said series of playing locations on the first playing surface indicating that a player whose piece lands thereon follows a game direction; and wherein the second playing surface includes:

a series of playing locations defined about said playing surface in substantially contiguous relationship having the shape of an octagon comprising a playing path wherein said playing pieces are moved in discrete steps between successive locations.

14. The board game as set forth in claim 13 further comprising:

a plurality of health question cards containing player questions indicating attributes of health.

15. The board game as set forth in claim 13 further comprising:

a match card containing a plurality of health problems, a plurality of preventive health care methods, and a plurality of preventive health care certificates.

* * * * *